US006659227B2

(12) United States Patent
Yamamoto et al.

(10) Patent No.: US 6,659,227 B2
(45) Date of Patent: Dec. 9, 2003

(54) OIL LEAK PREVENTION STRUCTURE FOR VACUUM PUMP

(75) Inventors: Shinya Yamamoto, Kariya (JP); Masahiro Kawaguchi, Kariya (JP); Satoru Kuramoto, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 8 days.

(21) Appl. No.: 10/140,313

(22) Filed: May 6, 2002

(65) Prior Publication Data

US 2002/0166731 A1 Nov. 14, 2002

(30) Foreign Application Priority Data

May 8, 2001 (JP) ..... 2001-137409

(51) Int. Cl.[7] ..... F01M 1/00
(52) U.S. Cl. ..... 184/6.16; 277/303
(58) Field of Search ..... 184/6.16; 277/303, 277/309, 306

(56) References Cited

U.S. PATENT DOCUMENTS 4,990,069 A 2/1991 Guittet et al. ..... 418/9
5,207,291 A * 5/1993 Mezzedimi et al. ..... 184/6.16
5,340,273 A * 8/1994 Rockwood ..... 415/113
5,499,902 A * 3/1996 Rockwood ..... 415/113

FOREIGN PATENT DOCUMENTS

| | | | |
|---|---|---|---|
| DE | 868 488 | 2/1953 | |
| GB | 2116634 A | 9/1983 | ..... F04C/18/14 |
| JP | 58-51294 A | 3/1983 | ..... F04C/27/00 |
| JP | 63-129829 | 6/1988 | ..... H02K/7/14 |
| JP | 03-011193 | 1/1991 | ..... F04D/19/04 |
| JP | 3-242489 A | 10/1991 | ..... F04C/18/16 |
| JP | 4-311696 A | 11/1992 | ..... F04C/25/02 |
| JP | 7-158571 | 6/1995 | ..... F04C/18/02 |

* cited by examiner

*Primary Examiner*—David Fenstermacher
(74) *Attorney, Agent, or Firm*—Morgan & Finnegan, LLP

(57) ABSTRACT

A Roots pump rotates a plurality of rotors by a pair of rotary shafts to draw gas. Each rotary shaft extends through a rear housing member of the Roots pump. A plurality of stoppers are located on each rotary shaft to integrally rotate with the corresponding rotary shaft, and prevent oil from entering a fifth pump chamber of the Roots pump. Stoppers have a circumferential surface, respectively. Annular oil chambers collect oil. The oil chambers are located about an axis of the rotary shaft to surround the circumferential surface of the stopper. This effectively prevents oil from entering the pump chamber of the Roots pump.

17 Claims, 9 Drawing Sheets

OIL LEAK PREVENTION STRUCTURE FOR VACUUM PUMP

BACKGROUND OF THE INVENTION

The present invention relates to an oil leak prevention structure of a vacuum pump that draws gas by rotating a rotary shaft to move a gas conveying body in a pump chamber.

Japanese Laid-Open Patent Publication No. 63-129829 and No. 3-11193 each disclose a vacuum pump. The pump of either publication introduces lubricant oil into the interior of the pump. Either pump prevents lubricant oil from entering regions where oil is not desirable.

The vacuum pump disclosed in Japanese Laid-Open Patent Publication No. 63-129829 includes a plate attached to a rotary shaft to prevent oil from entering a chamber for an electric generator. Specifically, when moving along the surface of the rotary shaft toward the generator chamber, oil reaches the plate. The centrifugal force of the plate spatters the oil to an annular groove formed about the plate. The oil flows to the lower portion of the annular groove and is then drained to the outside along an oil passage connected to the lower portion.

The vacuum pump disclosed in Japanese Laid-Open Patent Publication No. 3-11193 has an annular chamber for supplying oil to a bearing and a slinger provided in the annular chamber. When moving along the surface of a rotary shaft from the annular chamber to a vortex flow pump, oil is thrown away by the slinger. The thrown oil is then sent to a motor chamber through a drain hole connected to the annular chamber.

The plate (slinger) is a mechanism that integrally rotates with a rotary shaft to prevent oil from entering undesirable regions. The oil leak entry preventing operation utilizing centrifugal force of the plate (slinger) is influenced by the shape of the plate (slinger), and the shape of the walls surrounding the plate (slinger).

SUMMARY OF THE INVENTION

Accordingly, it is an objective of the present invention to provide an oil leak prevention mechanism that effectively prevents oil from entering a pump chamber of a vacuum pump.

To achieve the foregoing and other objectives and in accordance with the purpose of the present invention, the invention provides a vacuum pump. The vacuum pump draws gas by operating a gas conveying body in a pump chamber through rotation of a rotary shaft. The vacuum pump has an oil housing member, a stopper and an annular oil chamber. The oil housing member defines an oil zone adjacent to the pump chamber. The rotary shaft has a projecting section that projects from the pump chamber to the oil zone through the oil housing member. The stopper has a circumferential surface. The stopper is located on the rotary shaft to integrally rotate with the rotary shaft and prevents oil from entering the pump chamber. The oil chamber collects oil. The oil chamber is located about an axis of the rotary shaft to surround the circumferential surface of the stopper.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is an enlarged partial cross-sectional view of the pump shown in FIG. 1(*a*);

FIG. 2(*b*) is a cross-sectional view taken along line 2*b*—2*b* in FIG. 1(*a*);

FIG. 3(*b*) is a cross-sectional view taken along line 3*b*—3*b* in FIG. 1(*a*);

FIG. 4(*b*) is an enlarged cross-sectional view of FIG. 4(*a*);

FIG. 5(*b*) is an enlarged cross-sectional view of FIG. 5(*a*);

FIG. 6(*b*) is an enlarged cross-sectional view of FIG. 6(*a*);

DETAILED DESCRIPTION OF THE PREFERRED EMBODIMENTS

A multiple-stage Roots pump 11 according to a first embodiment of the present invention will now be described with reference to FIGS. 1(*a*) to 8.

Figure 1:
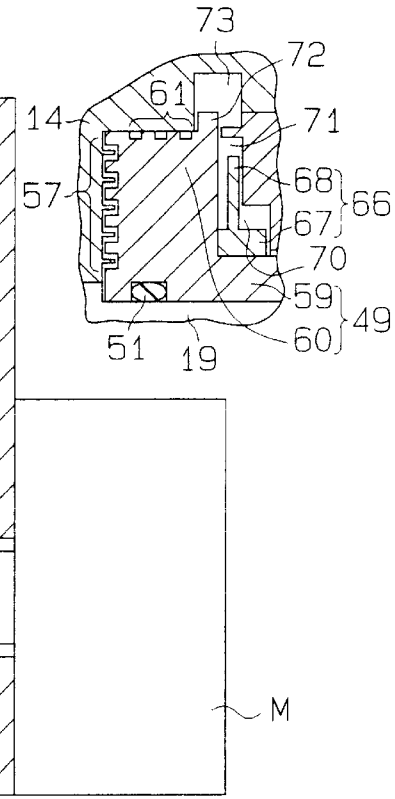
FIG. 1(*a*) is a cross-sectional plan view illustrating a multiple-stage Roots pump according to a first embodiment of the present invention.
Figure 1:
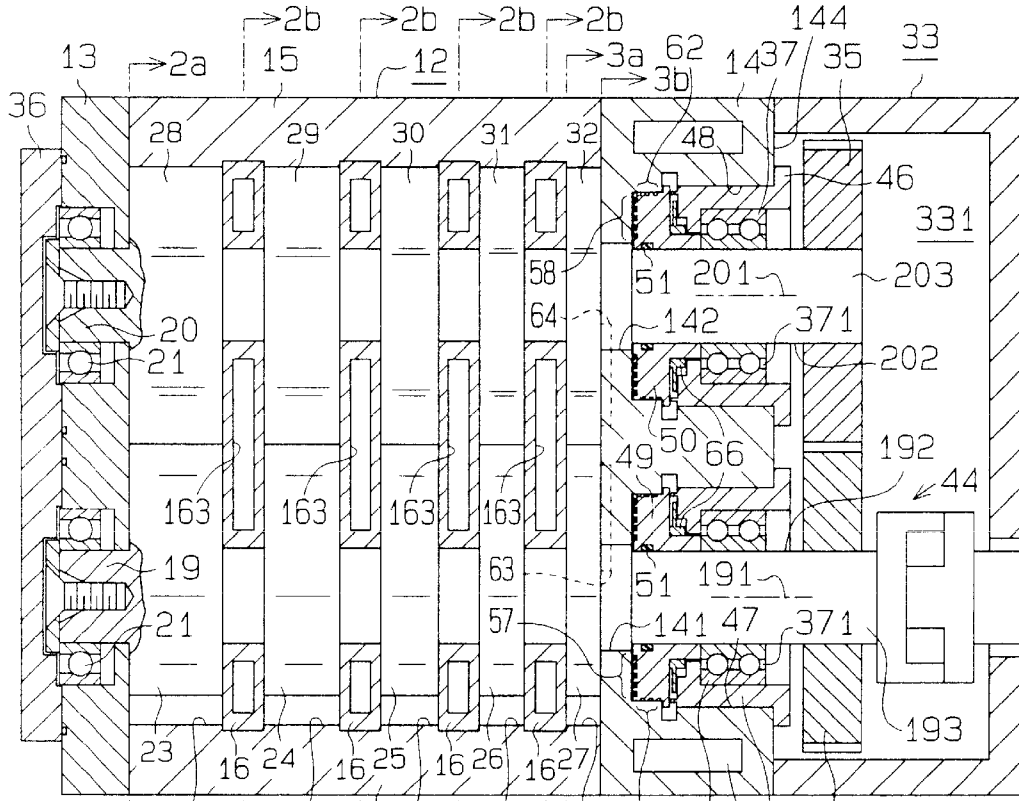
Figure 2A:
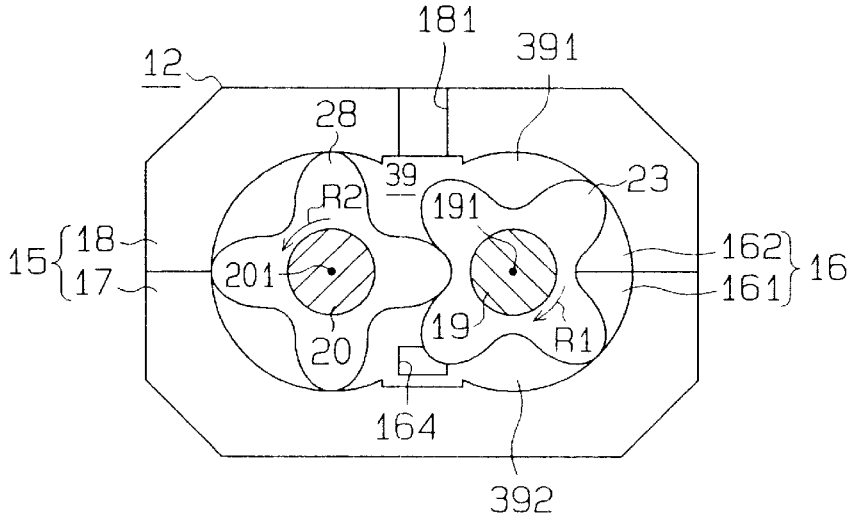
FIG. 2(*a*) is a cross-sectional view taken along line 2*a*—2*a* in FIG. 1(*a*)
Figure 2B:
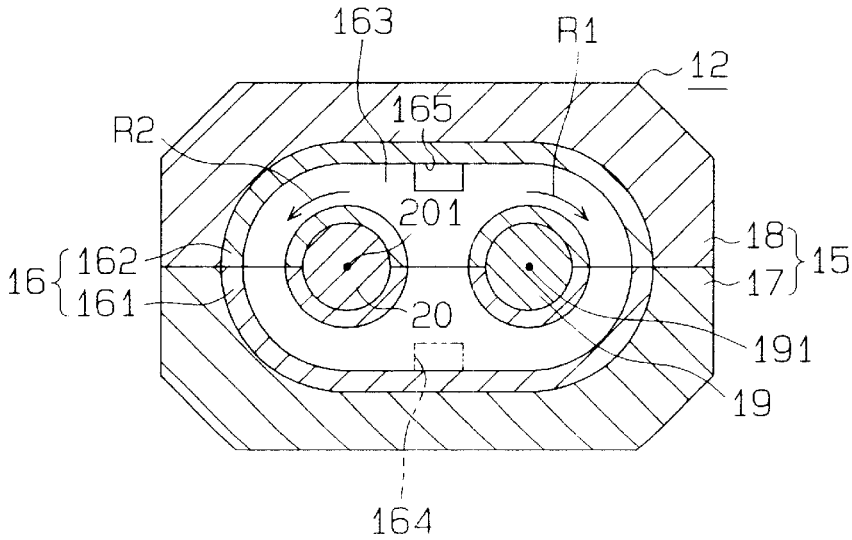

As shown in FIG. 1(*a*), the pump 11, which is a vacuum pump, includes a rotor housing member 12, a front housing member 13, and a rear housing member 14. The front housing member 13 is coupled to the front end of the rotor housing member 12. A lid 36 closes the front opening of the front housing member 13. The rear housing member 14 is coupled to the rear end of the rotor housing member 12. The rotor housing member 12 includes a cylinder block 15 and chamber defining walls 16, the number of which is four in this embodiment. As shown in FIG. 2(*b*), the cylinder block 15 includes a pair of blocks 17, 18. Each chamber defining wall 16 includes a pair of wall sections 161, 162.

As shown in FIG. 1(*a*), a first pump chamber 39 is defined between the front housing member 13 and the leftmost chamber defining wall 16. Second, third, and fourth pump chambers 40, 41, 42 are each defined between two adjacent chamber defining walls 16 in this order from the left to the right as viewed in the drawing. A fifth pump chamber 43 is defined between the rear housing member 14 and the rightmost chamber defining wall 16.

A first rotary shaft 19 is rotatably supported by the front housing member 13 and the rear housing member 14 with a pair of radial bearings 21, 37. Likewise, the second rotary shaft 20 is rotatably supported by the front housing member 13 and the rear housing member 14 with a pair of radial bearings 21, 37. The first and second rotary shafts 19, 20 are parallel with each other and extend through the chamber defining walls 16. The radial bearings 37 are supported by bearing holders 45 that are installed in the rear housing member 14. The bearing holders 45 are fitted in first and second recesses 47, 48 that are formed in the rear side of the rear housing member 14, respectively.

First, second, third, fourth, and fifth rotors 23, 24, 25, 26, 27 are formed integrally with the first rotary shaft 19. Likewise, first, second, third, fourth, and fifth rotors 28, 29, 30, 31, 32 are formed integrally with the second rotary shaft 20. As viewed in the direction along the axes 191, 201 of the rotary shafts 19, 20, the shapes and the sizes of the rotors 23–32 are identical. However, the axial dimensions of the first to fifth rotors 23–27 of the first rotary shaft 19 become gradually smaller in this order. Likewise, the axial dimensions of the first to fifth rotors 28–32 of the second rotary shaft 20 become gradually smaller in this order.

The first rotors 23, 28 are accommodated in the first pump chamber 39 and are engaged with each other. The second rotors 24, 29 are accommodated in the second pump chamber 40 and are engaged with each other. The third rotors 25, 30 are accommodated in the third pump chamber 41 and are engaged with each other. The fourth rotors 26, 31 are accommodated in the fourth pump chamber 42 and are engaged with each other. The fifth rotors 27, 32 are accommodated in the fifth pump chamber 43 and are engaged with each other. The first to fifth pump chambers 39–43 are not lubricated. Thus, the rotors 23–32 are arranged not to contact any of the cylinder block 15, the chamber defining walls 16, the front housing member 13, and the rear housing member 14. Further, the rotors of each engaged pair do not slide against each other.

Figure 3A:
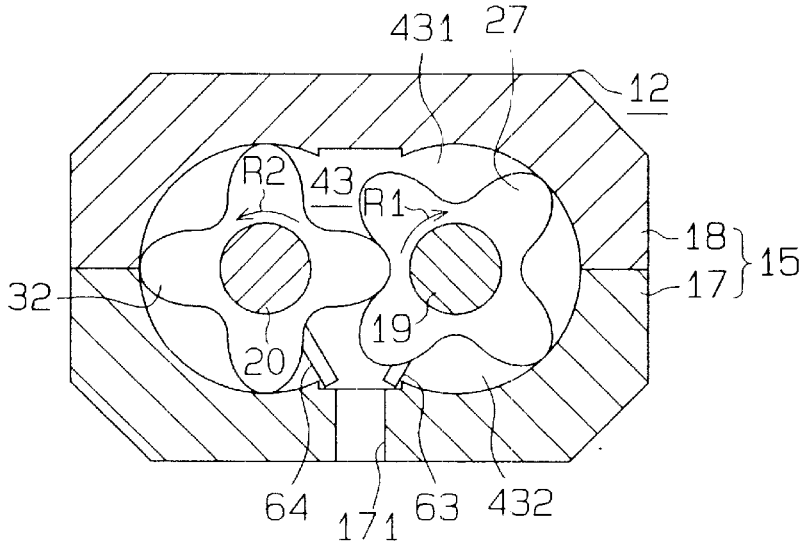
FIG. 3(*a*) is a cross-sectional view taken along line 3*a*—3*a* in FIG. 1(*a*)
Figure 3B:
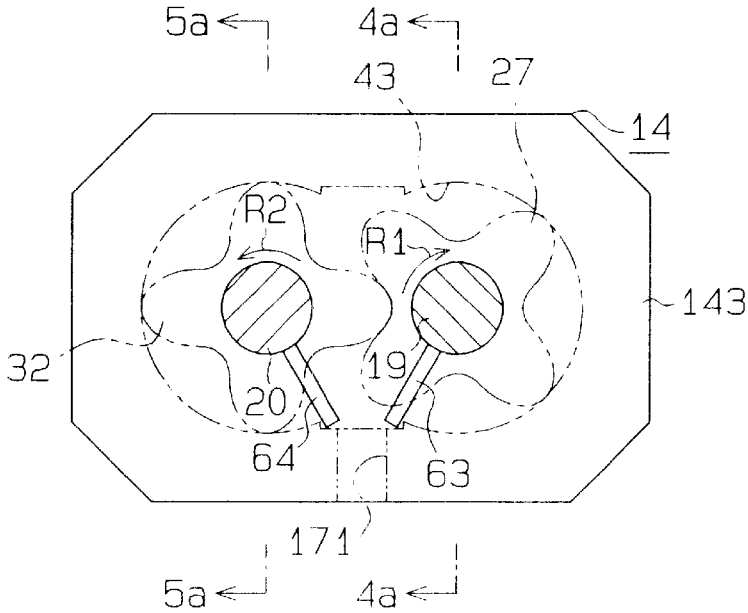

As shown in FIG. 2(*a*), the first rotors 23, 28 define a suction zone 391 and a pressure zone 392 in the first pump chamber 39. The pressure in the pressure zone 392 is higher than the pressure in the suction zone 391. Likewise, the second to fourth rotors 24–26, 29–31 define suction zones and pressure zones in the associated pump chambers 40–42. As shown in FIG. 3(*a*), the fifth rotors 27, 32 define a suction zone 431 and a pressure zone 432, which are similar to the suction zone 391 and the pressure zone 392, in the fifth pump chamber 43.

As shown in FIG. 1(*a*), a gear housing member 33 is coupled to the rear housing member 14. A pair of through holes 141, 142 is formed in the rear housing member 14. The rotary shafts 19, 20 extend through the through holes 141, 142 and the first and second recesses 47, 48, respectively. The rotary shafts 19, 20 thus project into the gear housing member 33 to form projecting portions 193, 203, respectively. Gears 34, 35 are secured to the projecting portions 193, 203, respectively, and are meshed together. An electric motor M is connected to the gear housing member 33. A shaft coupling 44 transmits the drive force of the motor M to the first rotary shaft 19. The motor M thus rotates the first rotary shaft 19 in the direction indicated by arrow R1 of FIGS. 2(*a*) to 3(*b*). The gears 34, 35 transmit the rotation of the first rotary shaft 19 to the second rotary shaft 20. The second rotary shaft 20 thus rotates in the direction indicated by arrow R2 of FIGS. 2(*a*) to 3(*b*). Accordingly, the first and second rotary shafts 19, 20 rotate in opposite directions. The gears 34, 35 form a gear mechanism to rotate the rotary shafts 19, 20 integrally.

Figure 4B:
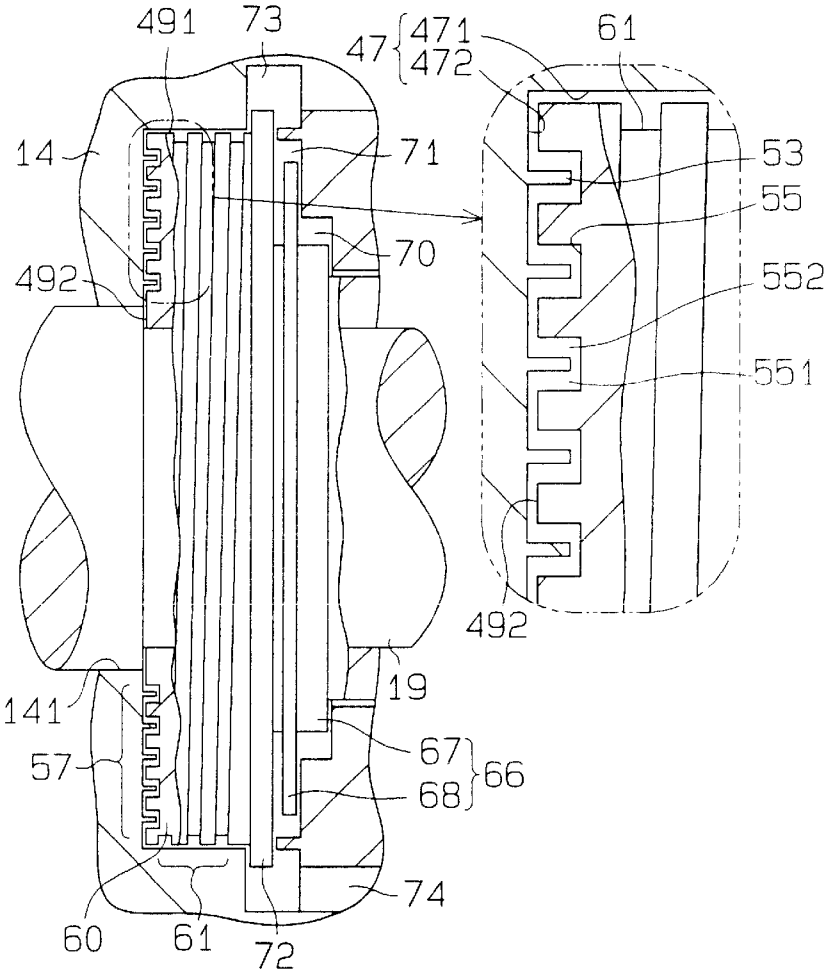
FIG. 4(*a*) is a cross-sectional view taken along line 4*a*—4*a* in FIG. 3(*b*)
Figure 4A:
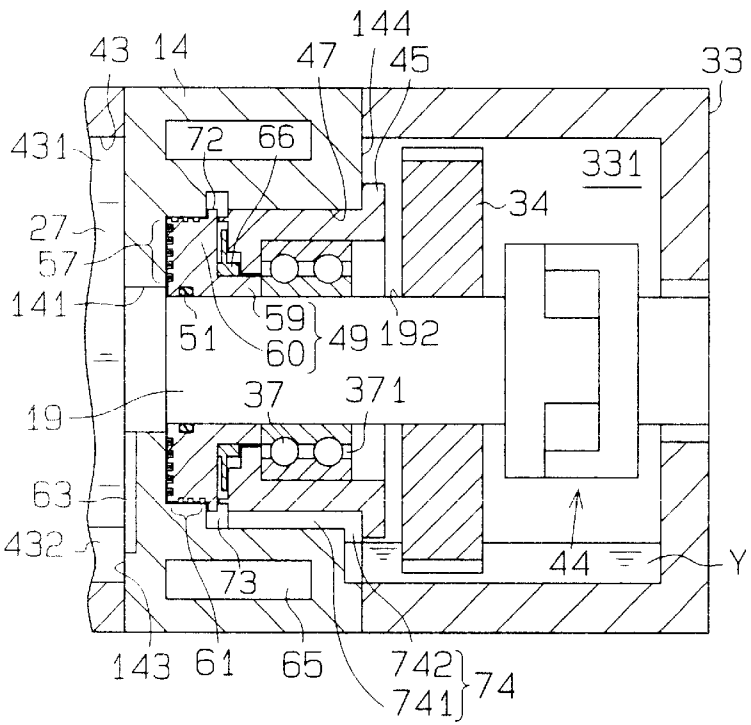

As shown in FIGS. 4(*a*) and 5(*a*), a gear accommodating chamber 331 is formed in the gear housing member 33 and retains lubricant oil Y for lubricating the gears 34, 35. The gear accommodating chamber 331 and the first and second recesses 47, 48 form a sealed oil zone. The gear housing member 33 and the rear housing member 14 thus form an oil housing, or an oil zone adjacent to the fifth pump chamber 43. The gears 34, 35 rotate to lift the lubricant oil Y in the gear accommodating chamber 331. The lubricant oil Y thus lubricates the radial bearings 37.

As shown in FIGS. 1(*a*) and 2(*b*), a hollow 163 is defined in each chamber defining wall 16. Each chamber defining wall 16 has an inlet 164 and an outlet 165 that are connected to the hollow 163. Each adjacent pair of the pump chambers 39–43 are connected to each other by the hollow 163 of the associated chamber defining wall 16.

As shown in FIG. 2(*a*), an inlet 181 is formed in the block 18 of the cylinder block 15 and is connected to the suction zone 391 of the first pump chamber 39. As shown in FIG. 3(*a*), an outlet 171 is formed in the block 17 of the cylinder block 15 and is connected to the pressure zone 432 of the fifth pump chamber 43. When gas enters the suction zone 391 of the first pump chamber 39 from the inlet 181, rotation of the first rotors 23, 28 moves the gas to the pressure zone 392. The gas is compressed in the pressure zone 392 and enters the hollow 163 of the adjacent chamber defining wall 16 from the inlet 164. The gas then reaches the suction zone of the second pump chamber 40 from the outlet 165 of the hollow 163. Afterwards, the gas flows from the second pump chamber 40 to the third, fourth, and fifth pump chambers 41, 42, 43 in this order while repeatedly compressed. The volumes of the first to fifth pump chambers 39–43 become gradually smaller in this order. When the gas reaches the suction zone 431 of the fifth pump chamber 43, rotation of the fifth rotors 27, 32 moves the gas to the pressure zone 432. The gas is then discharged from the outlet 171 to the exterior of the vacuum pump 11. That is, each rotor 23–32 functions as a gas conveying body for conveying gas.

The outlet 171 functions as a discharge passage for discharging gas to the exterior of the vacuum pump 11. The fifth pump chamber 43 is a final-stage pump chamber that is connected to the outlet 171. Among the pressure zones of the first to fifth pump chambers 39–43, the pressure in the pressure zone 432 of the fifth pump chamber 43 is the highest, and the pressure zone 432 functions as a maximum pressure zone.

As shown in FIG. 1(*a*), first and second annular shaft seals 49, 50 are securely fitted about the first and second rotary shafts 19, 20, respectively, and are located in the first and second recesses 47, 48, respectively. Each of the first and second shaft seals 49, 50 rotates with the corresponding rotary shaft 19, 20. A seal ring 51 is located between the inner circumferential surface of each of the first and second shaft seals 49, 50 and the circumferential surface 192, 202 of the corresponding rotary shaft 19, 20. Each seal ring 51 prevents the lubricant oil Y from leaking from the associated recess 47, 48 to the fifth pump chamber 43 along the circumferential surface 192, 202 of the associated rotary shaft 19, 20.

Figure 5B:
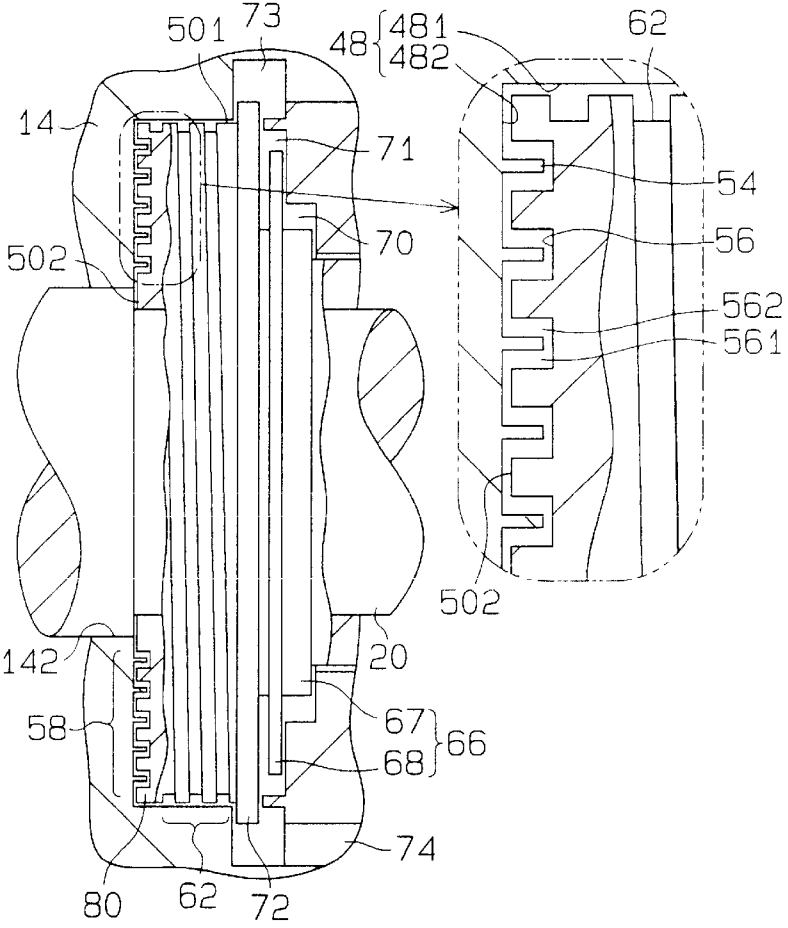
FIG. 5(*a*) is a cross-sectional view taken along line 5*a*—5*a* in FIG. 3(*b*)
Figure 5A:
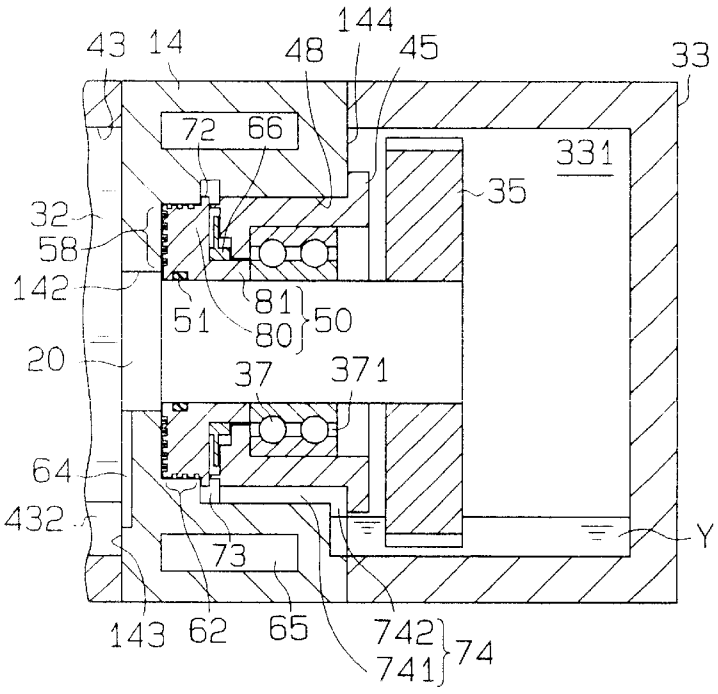
Figures 6A, 6B:
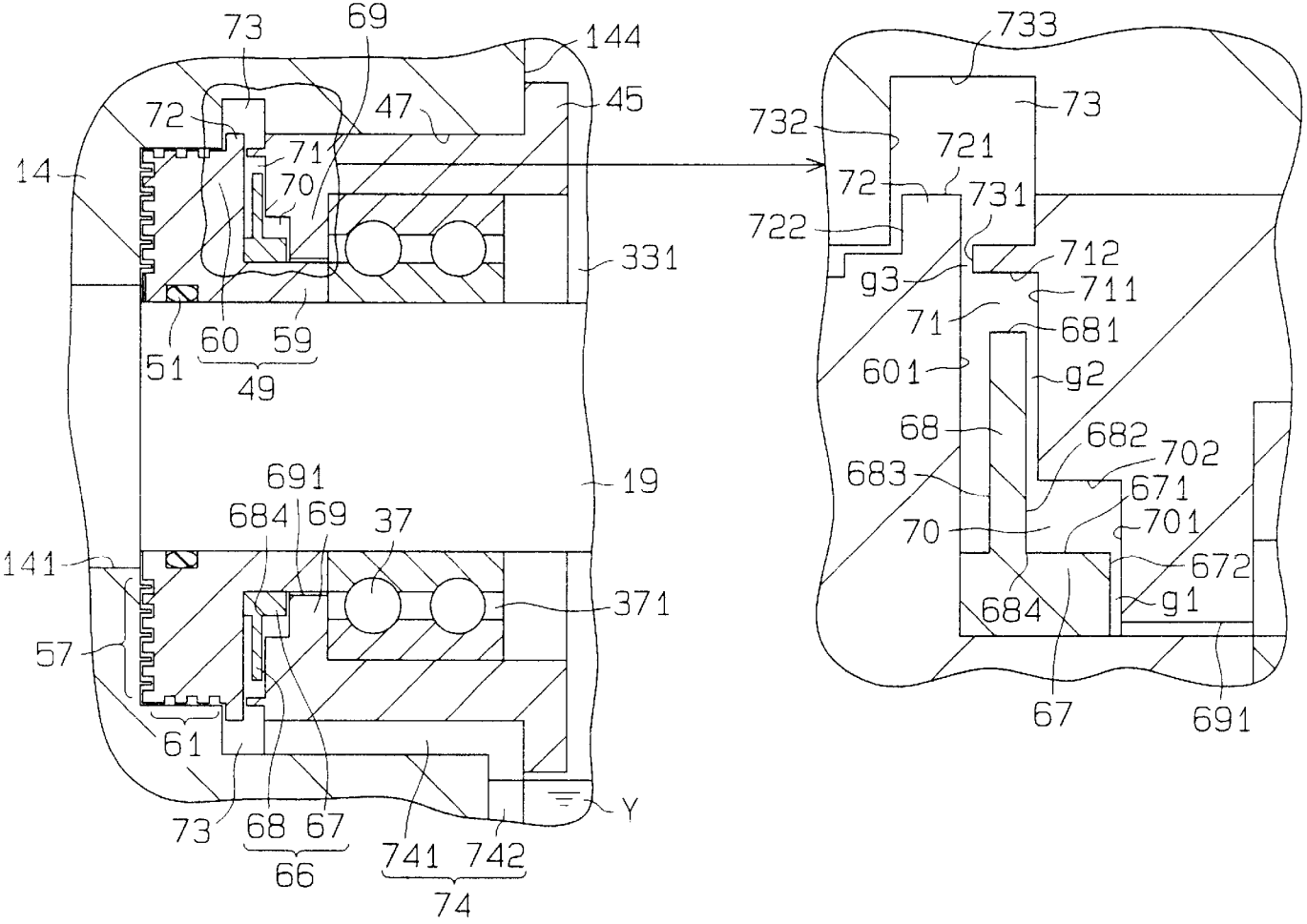
FIG. 6(*a*) is an enlarged cross-sectional view of the pump shown in FIG. 1(*a*)
Figure 7:
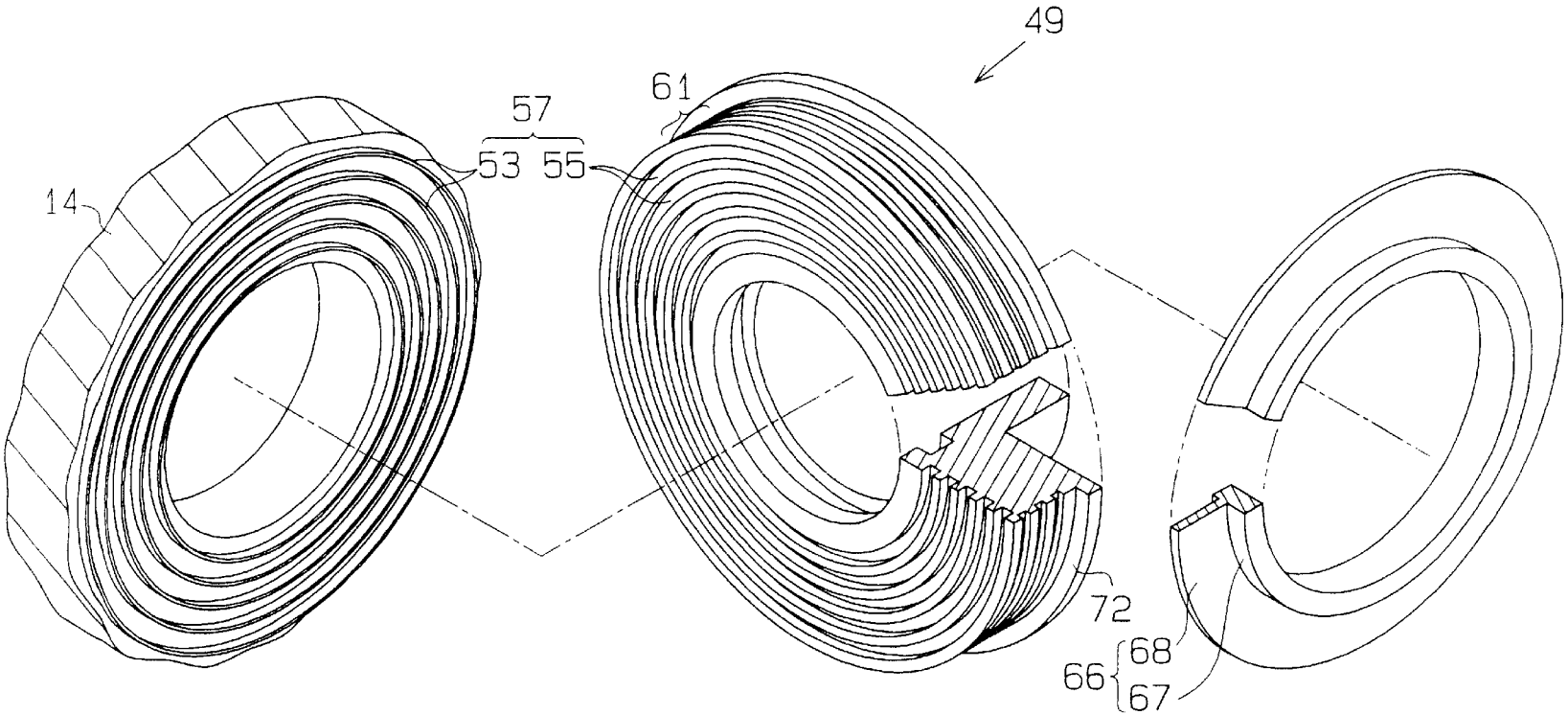
FIG. 7 is an exploded perspective view illustrating part of the rear housing member, the first shaft seal, and a leak prevention ring of the pump shown in FIG. 1(*a*)
Figure 8:
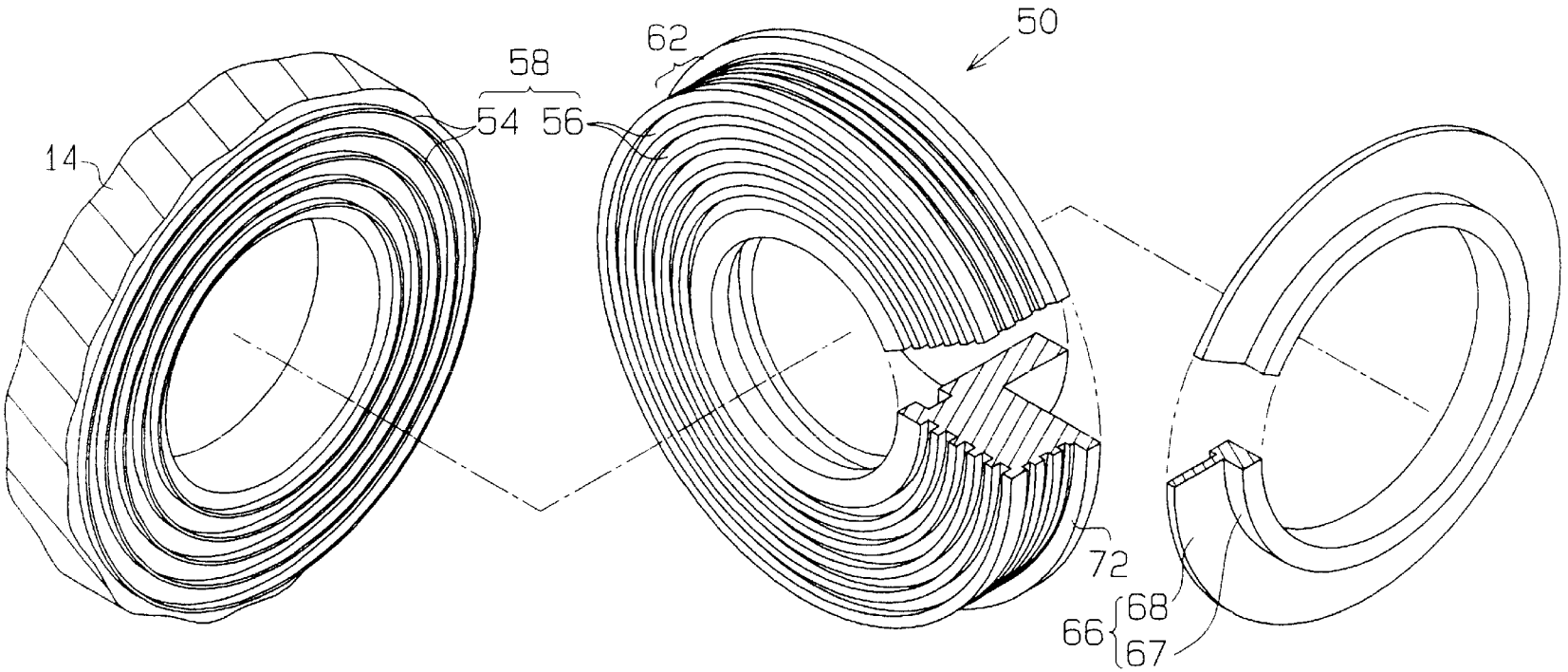
FIG. 8 is an exploded perspective view illustrating part of the rear housing member, the second shaft seal, and a leak prevention ring of the pump shown in FIG. 1(*a*)

As shown in FIG. 4(*a*), the shaft seal 49 includes a small diameter portion 59 and a large diameter portion 60. As shown in FIG. 4(*b*), space exists between the outer circumferential surface 491 of the large diameter portion 60 and the circumferential surface 471 of the first recess 47. Also, space exists between the end surface 492 of the first shaft seal 49 and the bottom 472 of the first recess 47. As shown in FIG. 5(*a*), the second shaft seal 50 includes a small diameter portion 81 and a large diameter portion 80. As shown in FIG.

5(*b*), space exists between the circumferential surface 501 of the large diameter portion 80 and the circumferential surface 481 of the second recess 48. Also, space exists between the end surface 502 of the second shaft seal 50 and the bottom 482 of the second recess 48.

Annular projections 53 coaxially project from the bottom 472 of the first recess 47. In the same manner, annular projections 54 coaxially project from the bottom 482 of the second recess 48. Further, annular grooves 55 are coaxially formed in the end surface 492 of the shaft seal 49, which faces the bottom 472 of the first recess 47. In the same manner, annular grooves 56 are coaxially formed in the front side 502 of the shaft seal 50, which faces the bottom 482 of the second recess 48. Each annular projection 53, 54 projects in the associated groove 55, 56 such that the distal end of the projection 53, 54 is located close to the bottom of the groove 55, 56. Each projection 53 divides the interior of the associated groove 55 of the first shaft seal 49 to a pair of labyrinth chambers 551, 552. Each projection 54 divides the interior of the associated groove 56 of the second shaft seal 50 to a pair of labyrinth chambers 561, 562.

The projections 53 and the grooves 55 form a first labyrinth seal 57 corresponding to the first rotary shaft 19. The projections 54 and the grooves 56 form a second labyrinth seal 58 corresponding to the second rotary shaft 20. In this embodiment, the end surface 492 and the bottom 472 are formed along a plane perpendicular to the axis 191 of the first rotary shaft 19. Likewise, the end surface 502 and the bottom 482 are formed along a plane perpendicular to the axis 201 of the rotary shaft 20. In other words, the end surface 492 and the bottom 472 are seal forming surfaces that extend in a radial direction of the first shaft 19. Likewise, the end surface 502 and the bottom 482 are seal forming surfaces that extend in a radial direction of the second shaft 50.

As shown in FIGS. 4(*b*) and 7, a first helical groove 61 is formed in the outer circumferential surface 491 of the large diameter portion 60 of the first shaft seal 49. As shown in FIGS. 5(*b*) and 8, a second helical groove 62 is formed in the outer circumferential surface 501 of the large diameter portion 80 of the second shaft seal 50. Along the rotational direction R1 of the first rotary shaft 19, the first helical groove 61 forms a path that leads from a side corresponding to the gear accommodating chamber 331 toward the fifth pump chamber 43. Along the rotational direction R2 of the second rotary shaft 20, the second helical groove 62 forms a path that leads from a side corresponding to the gear accommodating chamber 331 toward the fifth pump chamber 43. Therefore, each helical groove 61, 62 exert a pumping effect and convey fluid from a side corresponding to the fifth pump chamber 43 toward the gear accommodating chamber 331 when the rotary shafts 19, 20 rotate. That is, each helical groove 61, 62 forms pumping means that urges the lubricant oil Y between the outer circumferential surface 491, 501 of the associated shaft seal 49, 50 and the circumferential surface 471, 481 of the associated recess 47, 48 to move from a side corresponding to the fifth pump chamber 43 toward the oil zone. The circumferential surface 471, 481 of each recess 47, 48 functions as a sealing surface. The outer circumferential surface 491, 501 of the large diameter portion 60, 80 of each shaft seal 49, 50 faces the corresponding circumferential surface 471, 481.

As shown in FIG. 3(*b*), first and second discharge pressure introducing channels 63, 64 are formed in a chamber defining surface 143 of the rear housing member 14. The chamber defining surface 143 defines the fifth pump chamber 43, which is at the final stage of compression. As shown in FIG. 4(*a*), the first discharge pressure introducing channel 63 is connected to the maximum pressure zone 432, the volume of which is varied by rotation of the fifth rotors 27, 32. The first discharge pressure introducing channel 63 is connected also to the through hole 141, through which the first rotary shaft 19 extends. As shown in FIG. 5(*a*), the second discharge pressure introducing channel 64 is connected to the maximum pressure zone 432 and the through hole 142, through which the second rotary shaft 20 extends.

As shown in FIGS. 1(*a*), 4(*a*), and 5(*a*), a cooling loop chamber 65 is formed in the rear housing member 14. The loop chamber 65 surrounds the shaft seals 49, 50. Coolant water circulates in the loop chamber 65 to cool the lubricant oil Y in the recesses 47, 48, which prevents the lubricant oil Y from being evaporated.

As shown in FIGS. 1(*b*), 6(*a*) and 6(*b*), an annular leak prevention ring 66 is fitted about the small diameter portion 59 of the first shaft seal 49 to block flow of oil. The leak prevention ring 66 includes a first stopper 67 having a smaller diameter and a second stopper 68 having a larger diameter. The front end portion 69 of the bearing holder 45 defines an annular first oil chamber 70 and an annular second oil chamber 71 about the leak prevention ring 66. The first oil chamber 70 surrounds the first stopper 67, and the second oil chamber 71 surrounds the second stopper 68.

A circumferential surface 671 is located in the first oil chamber 70. A circumferential surface 681 of the second stopper 68 is located in the second oil chamber 71. The circumferential surface 671 of the first stopper 67 faces a circumferential surface 702, which defines the first oil chamber 70. The circumferential surface 681 of the second stopper 68 faces a circumferential surface 712, which defines the second oil chamber 71.

An end surface 672 of the first stopper 67 faces a end surface 701, which defines the first oil chamber 70. A first end surface 682 of the second stopper 68 faces and is located in the vicinity of a end surface 711, which defines the second oil chamber 71. A second end surface 683 of the second stopper 68 faces and is widely separated from a first end surface 601 of a third stopper 72. The third stopper 72 will be discussed below.

The third stopper 72 is integrally formed with the large diameter portion 60 of the first shaft seal 49. An annular oil chamber 73 is defined in the first recess 47 to surround the third stopper 72. A circumferential surface 721 of the third stopper 72 is defined on a portion that projects into the third oil chamber 73. Also, the circumferential surface 721 of the third stopper 72 faces a circumferential surface 733 defining the third oil chamber 73. The first end surface 601 of the third stopper 72 faces and is located in the vicinity of a first end surface 731 defining the third oil chamber 73. A second end surface 722 of the third stopper 72 faces and is located in the vicinity of a second end surface 732 defining the third oil chamber 73.

A drainage channel 74 is defined in the lowest portion of the first recess 47 and the end 144 of the rear housing 14 to return the oil Y to the gear accommodation chamber 331. The drainage channel 74 has an axial portion 741, which extends along the axis 191 of the first rotary shaft 19, and a radial portion 742, which extends perpendicular to the axis 191. The axial portion 741 is communicated with the third oil chamber 73, and the radial portion 742 is communicated with the gear accommodation chamber 331. That is, the third oil chamber 73 is connected to the gear accommodating chamber 331 by the drainage channel 74. The drainage channel 74 is axially formed in the first embodiment.

However, the drainage channel 74 may be inclined downward toward the gear accommodating chamber 331.

As shown in FIG. 5(*a*), the leak prevention ring 66 is attached to the small diameter portion 81 of the second shaft seal 50. The leak prevention ring 66 has the same structure as the leak prevention ring 66 attached to the first shaft seal 49. Thus, detailed explanations are omitted. A third stopper 72 is formed on the large diameter portion 80 of the second shaft seal 50. The third stopper 72 has the same structure as the third stopper 72 formed on the first shaft seal 49. Thus, detailed explanations are omitted. As shown in FIG. 5(*b*), the first and second oil chambers 70, 71 are defined radially inward of the bearing holder 45, and the third oil chamber 73 is defined in the second recess 48. The drainage channel 74 is formed in the lowest portion of the second recess 48. The third oil chamber 73 is connected to the gear accommodating chamber 331 by the drainage channel 74. The drainage channel 74 is axially formed in the first embodiment. However, the drainage channel 74 may be inclined downward toward the gear accommodating chamber 331.

The lubricant oil Y stored in the gear accommodating chamber 331 lubricates the gears 34, 35 and the radial bearings 37. After lubricating the radial bearings 37, the oil Y enters a through hole 691 formed in the projection 69 of each bearing holder 45 through a space 371 in each radial bearing 37. Then, the oil Y moves toward the corresponding first oil chamber 70 via a space g1 between the end surface 672 of the corresponding first stopper 67 and the end surface 701 of the corresponding first oil chamber 70. At this time, some of the oil Y that reaches the end surface 672 of the first stopper 67 is thrown to the circumferential surface 702 or the end surface 701 of the first oil chamber 70 by the centrifugal force generated by rotation of the first stopper 67. At least part of the oil Y thrown to the circumferential surface 702 or the end surface 701 remains on the circumferential surface 702 or the end surface 701. Then, the remaining oil Y falls along the surfaces 701, 702 by the self weight and reaches the lowest area of the first oil chamber 70. After reaching the lowest area of the first oil chamber 70, the oil Y moves to the lowest area of the second oil chamber 71.

After entering the first oil chamber 70, the oil Y moves toward the second oil chamber 71 through a space g2 between the first end surface 682 of the second stopper 68 and the end surface 711 of the second oil chamber 71. At this time, the oil Y on the first end surface 682 is thrown to the circumferential surface 712 or the end surface 711 of the second oil chamber 71 by the centrifugal force generated by rotation of the second stopper 68. At least part of the oil Y thrown to the circumferential surface 712 or the end surface 711 remains on the circumferential surface 712 or the end surface 711. The remaining oil Y falls along the surfaces 711, 712 by the self weight and reaches the lowest area of the second oil chamber 71. After reaching the lowest area of the second oil chamber 71, the oil Y moves to the lowest area of the third oil chamber 73.

After entering the second oil chamber 71, the oil Y moves toward the third oil chamber 73 through the space g3 between the first end surface 601 of the third stopper 72 and the first end surface 731 of the third oil chamber 73. At this time, the oil Y on the first end surface 601 is thrown to the circumferential surface 733 or the first end surface 731 of the third oil chamber 73 by the centrifugal force generated by rotation of the third stopper 72. At least part of the oil thrown to the circumferential surface 733 or the first end surface 731 remains on the circumferential surface 733 or the first end surface 731. Then, the remaining oil falls along the surfaces 731, 733 by the self-weight and reaches the lowest area of the third oil chamber 73.

After reaching the lowest area of the third oil chamber 73, the oil Y is returned to the gear accommodating chamber 331 by the corresponding drainage channel 74.

The first, second, and third oil chambers 70, 71, and 73 and the spaces g1, g2, and g3 form a bent path, which extends from the fifth pump chamber 43 to the gear accommodating chamber 331. Likewise, another bent path is formed around the second shaft seal 50.

The above illustrated embodiment has the following advantages.

(1-1) While the vacuum pump is operating, the pressures in the five pump chambers 39, 40, 41, 42, 43 are lower than the pressure in the gear accommodating chamber 331, which is a zone exposed to the atmospheric pressure. Thus, the atomized lubricant oil Y moves along the surface of the leak prevention rings 66 and the surface of the shaft seals 49, 50 toward the fifth pump chamber 43. The atomized lubricant oil Y is more easily liquefied in a bent path than in a straight path. That is, when the atomized lubricant oil Y collides with the wall forming a bent path, the atomized lubricant oil Y is easily liquefied. The path along which the atomized lubricant oil Y in the first oil chamber 70 moves is bent by the first stopper 67 located in the first oil chamber 70. The path along which the atomized lubricant oil Y in the second oil chamber 71 moves is bent by the second stopper 68 located in the second oil chamber 71. Further, the path along which the atomized lubricant oil Y in the third oil chamber 73 moves is bent by the third stopper 72 located in the third oil chamber 73. The first, second, and third stoppers 67, 68, 72 each corresponding to one of the oil chambers 70, 71, 73 prevents the atomized lubricant oil Y from easily flowing toward the fifth pump chamber 43.

(1-2) The gear accommodating chamber 331 is communicated with the first oil chamber 70 with a first oil entering passage including the through hole 691 and the space g1 between the end surface 672 of the first stopper 67 and the end surface 701 of the first oil chamber 70. The first stopper 67 is arranged to narrow the space g1, which serves as the outlet of the first oil entering passage.

The gear accommodating chamber 331 is communicated with the second oil chamber 71 with a second oil entering passage including the first oil chamber 70 and the space g2 between the first end surface 682 of the second stopper 68 and the end surface 711 of the second oil chamber 71. The second stopper 68 is arranged to narrow the space g2, which serves as the outlet of the second oil entering passage.

The gear accommodating chamber 331 is communicated with the third oil chamber 73 with an third oil entering passage including the second oil chamber 71 and the space g3 between the first end surface 601 of the third stopper 72 and the first end surface 731 of the third oil chamber 73. The third stopper 72 is arranged to narrow the space g3, which serves as the outlet of the third oil entering passage.

The outlet of the first oil entering passage (space g1), the outlet of the second oil entering passage (space g2), and the outlet of the third oil entering passage (space g3) are narrowed to effectively prevent the atomized lubricant oil Y in the gear accommodating chamber 331 from entering the corresponding oil chamber 70, 71, 73.

(1-3) The lubricant oil Y on the surfaces 701, 702, 711, 712, 731, 732, 733 of the first, second, and third oil chambers 70, 71, 73 falls toward the lowest area of the third oil chambers 73 by the self weight. The lowest area of the third oil chamber 73 is an area at which the oil Y on the surfaces 701, 702, 711, 712, 731, 732, 733 is collected. Therefore, the oil Y on the surfaces 701, 702, 711, 712, 731, 732, 733 is readily sent to the gear accommodating chamber 331 via the drainage channel 74 connected to the lowest area of the third oil chamber 73.

(1-4) The first oil chamber 70 and the second oil chamber 71 are defined by the front end portion 69 of the bearing holder 45, which supports the radial bearing 37. This structure easily forms highly sealed oil chambers 70, 71.

(1-5) The diameters of the end surfaces 492, 502 of the shaft seals 49, 50 fitted about the first and second rotary shafts 19, 20 are greater than the diameters of the circumferential surfaces 192, 202 of the rotary shafts 19, 20. Therefore, the diameter of each of the first and second labyrinth seals 57, 58 located between the end surface 492, 502 of each shaft seal 49, 50 and the bottom surface 472, 482 of the corresponding recess 472, 482 is greater than the diameter of the labyrinth seal (not shown) located between the circumferential surface 192, 202 of each rotary shaft 19, 20 and the through hole 141, 142. As the diameter of each labyrinth seal 57, 58 is increased, the volume of each labyrinth chamber 551, 552, 561, 562 for preventing pressure fluctuations from spreading is increased. This structure improves the sealing performance of each labyrinth seal 57, 58. That is, the space between the end surface 492, 502 of each shaft seal 49, 50 and the bottom surface 472, 482 of the associated recess 47, 48 is suitable for accommodating the labyrinth seal 57, 58 for improving the sealing performance by increasing the volume of each labyrinth chamber 551, 552, 561, 562.

(1-6) As the space between each recess 47, 48 and the corresponding shaft seal 49, 50 is decreased, it is harder for the oil Y to enter the space. The bottom surface 472, 482 of each recess 47, 48, which has the circumferential surface 471, 481, and the end surface 492, 502 of the corresponding shaft seal 49, 50 are easily formed to be close to each other. Therefore, the space between the end of each annular projection 53, 54 and the bottom of the corresponding annular groove 55, 56 and the space between the bottom surface 472, 482 of each recess 47, 48 and the end surface 492, 502 of the corresponding shaft seal 49, 50 can be easily decreased. As the spaces are decreased, the sealing performance of the labyrinth seals 57, 58 is improved. That is, the bottom surface 472, 482 of each recess 47, 48 is suitable for accommodating the labyrinth seals 57, 58.

(1-7) The labyrinth seals 57, 58 sufficiently blocks flow of gas. When the Roots pump 11 is started, the pressures in the five pump chambers 39–43 are higher than the atmospheric pressure. However, each labyrinth seal 57, 58 prevents gas from leaking from the fifth pump chamber 43 to the gear accommodating chamber 331 along the surface of the associated shaft seal 49, 50. That is, the labyrinth seals 57, 58 stop both oil leak and gas leak and are optimal non-contact type seals.

(1-8) Although the sealing performance of a non-contact type seal does not deteriorate over time unlike a contact type seal such as a lip seal, the sealing performance of a non-contact type seal is inferior to the sealing performance of a contact type seal. However, in the above described embodiment, the first, second and third stoppers 67, 68, 72 compensate for the sealing performance. Each circumferential surface 671, 681, 721 corresponds to the projecting portion of the associated stopper 67, 68, 72 and is defined in the corresponding oil chamber 70, 71, 73. The circumferential surfaces 671, 681, 721 further compensate for the sealing performance.

(1-9) As the first rotary shaft 19 rotates, the oil Y in the first helical groove 61 is guided from the side corresponding to the fifth pump chamber 43 to the side corresponding to the gear accommodating chamber 331. As the second rotary shaft 20 rotates, the oil Y in the second helical groove 62 is guided from the side corresponding to the fifth pump chamber 43 to the side corresponding to the gear accommodating chamber 331. That is, the shaft seals 49, 50, which have the first and second helical grooves 61, 62 functioning as pumping means, positively prevent leakage of the oil Y.

(1-10) The outer circumferential surfaces 491, 501, on which the helical grooves 61, 62 are formed, coincide with the outer surface of the large diameter portions 60, 80 of the first and second shafts 49, 50. At these parts, the velocity is maximum when the shaft seals 49, 50 rotate. Gas located between the outer circumferential surface 491, 501 of each shaft seal 49, 50 and the circumferential surface 471, 481 of the corresponding recess 47, 48 is effectively urged from the side corresponding to the fifth pump chamber 43 to the side corresponding to the gear accommodating chamber 331 through the first and second helical grooves 61, 62, which are moving at a high speed. The lubricant oil Y located between the outer circumferential surface 491, 501 of each shaft seal 49, 50 and the circumferential surface 471, 481 of the corresponding recess 47, 48 flows with gas that is effectively urged from the side corresponding to the fifth pump chamber 43 to the side corresponding to the gear accommodating chamber 331. The helical grooves 61, 62 formed in the outer circumferential surface 491, 501 of the shaft seals 49, 50 effectively prevent the oil Y from leaking into the fifth pump chamber 43 from the recesses 47, 48 via the spaces between the outer circumferential surfaces 491, 501 and the circumferential surfaces 471, 481.

(1-11) Part of the lubricant oil Y guided from the side corresponding to the fifth pump chamber 43 toward the side corresponding to the gear accommodating chamber 331 with the helical grooves 61, 62 reaches the second end surface 722 of the third stopper 72. The lubricant oil Y on the second end surface 722 is thrown to the third end surface 733 of the third oil chamber 73 by the centrifugal force generated by the rotation of the third stopper 72. The thrown lubricant oil Y then reaches the third end surface 733. That is, the third stopper 72 returns the lubricant oil Y, which is guided from the side corresponding to the fifth pump chamber 43 to the side corresponding to the gear accommodating chamber 331 by the helical grooves 61, 62, to the gear accommodating chamber 331 via the third oil chamber 73.

(1-12) A small space is created between the circumferential surface 192 of the first rotary shaft 19 and the through hole 141. Also, a small space is created between each rotor 27, 32 and the wall forming surface 143 of the rear housing member 14. Therefore, the labyrinth seal 57 is exposed to the pressure in the fifth pump chamber 43 introduced through the narrow spaces. Likewise, a small space is created between the circumferential surface 202 of the second rotary shaft 20 and the through hole 142. Therefore, the second labyrinth seal 58 is exposed to the pressure in the fifth pump chamber 43 through the space. If there are no channels 63, 64, the labyrinth seals 57, 58 are equally exposed to the pressure in the suction pressure zone 431 and to the pressure in the maximum pressure zone 432.

The first and second discharge pressure introducing channels 63, 64 readily expose the labyrinth seals 57, 58 to the pressure in the maximum pressure zone 432. That is, the labyrinth seals 57, 58 are influenced more by the pressure in the maximum pressure zone 432 via the introducing channels 63, 64 than by the pressure in the suction pressure zone 431. Thus, compared to a case where no discharge pressure introducing channels 63, 64 are formed, the labyrinth seals 57, 58 of the illustrated embodiment receive higher pressure. As a result, compared to a case where no discharge pressure introducing channels 63, 64 are formed, the difference between the pressure acting on the front surface of the labyrinth seals 57, 58 and the pressure acting on the rear surface of the labyrinth seals 57, 58 is significantly small. In other words, the discharge pressure introducing channels 63, 64 significantly improves the oil leakage preventing performance of the labyrinth seals 57, 58.

(1-13) Since the Roots pump 11 is a dry type, no lubricant oil Y is used in the five pump chambers 39, 40, 41, 42, 43. Therefore, the present invention is suitable for the Roots pump 11.

A second embodiment according to the present invention will now be described with reference to FIG. 9. Mainly, the differences from the embodiment of FIGS. 1 to 8 will be discussed below. Since the sealing of the first and second rotary shafts 19, 20 have the same structure, only the sealing of the first rotary shaft 19 will be described.

Figure 9:
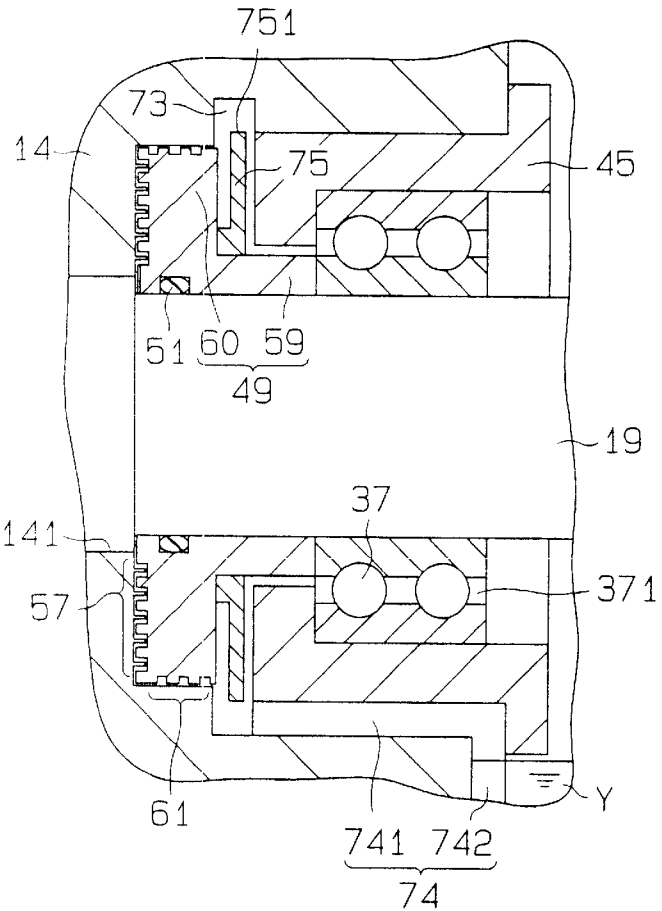
FIG. 9 is an enlarged cross-sectional view illustrating a second embodiment of the present invention.

As shown in FIG. 9, the leak prevention ring 75 is fitted about the small diameter portion 59 of the first shaft seal 49. The circumferential surface 751 of the leak prevention ring 75 is defined at the portion projecting into the third oil chamber 73.

Figure 10:
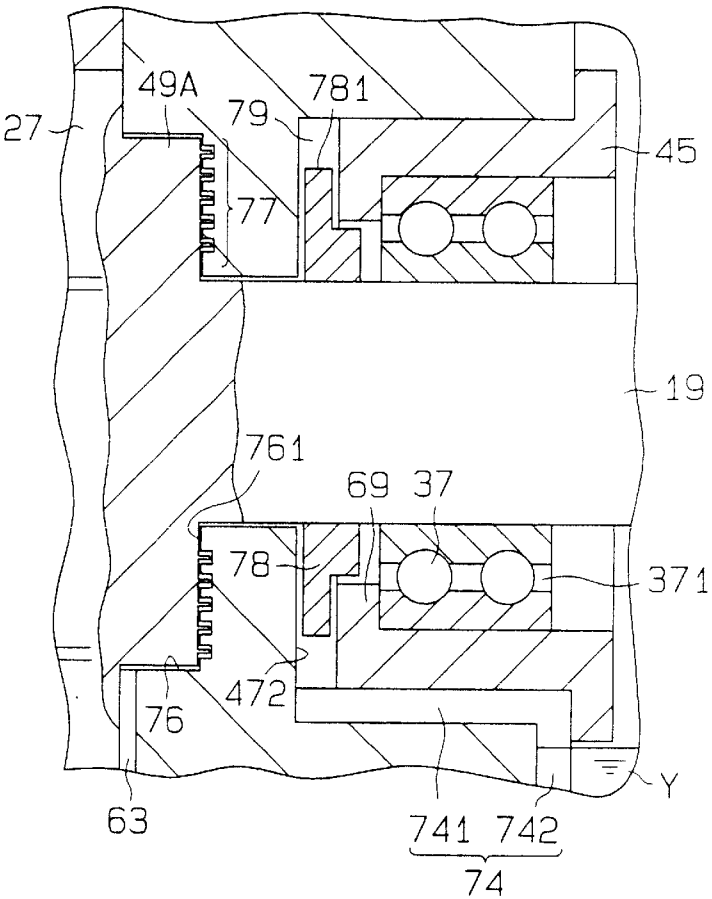
FIG. 10 is an enlarged cross-sectional view illustrating a third embodiment of the present invention.

A third embodiment according to the present invention is shown in FIG. 10. Since the sealing of the first and second rotary shafts 19, 20 have the same structure, only the sealing of the first rotary shaft 19 will be described. The first shaft seal 49A is integrally formed with the end surface of the first rotary shaft 19 and the fifth rotor 27. The first shaft seal 49A is fitted to a recess 76, which is formed on the end surface of the rear housing 14 facing the rotor housing 12. The labyrinth seal 77 is provided between the end surface of the first shaft seal 49A and the bottom surface 761 of the recess 76.

The leak prevention ring 78 is fitted about the first rotary shaft 19. The annular oil chamber 79 is defined between the bottom surface 472 of the first recess 47 and the front end portion 69 of the bearing holder 45.

The illustrated embodiments may be modified as follows.

(1) In the embodiment shown in FIGS. 1 to 8, each shaft seal 49, 50 may be integrally formed with the corresponding leak prevention ring 66.

(2) The present invention may be applied to other types of vacuum pumps than Roots types.

Therefore, the present examples and embodiments are to be considered as illustrative and not restrictive and the invention is not to be limited to the details given herein, but may be modified within the scope and equivalence of the appended claims.

What is claimed is:

1. A vacuum pump that draws gas by operating a gas conveying body in a pump chamber through rotation of a rotary shaft, the vacuum pump comprising:

an oil housing member, wherein the oil housing member defines an oil zone adjacent to the pump chamber, and the rotary shaft has a projecting section that projects from the pump chamber to the oil zone through the oil housing member;

a stopper having a circumferential surface, wherein the stopper is located on the rotary shaft to integrally rotate with the rotary shaft and prevents oil from entering the pump chamber; and an annular oil chamber for collecting oil, wherein the oil chamber is located about an axis of the rotary shaft to surround the circumferential surface of the stopper.

2. The pump according to claim 1, wherein the stopper is one of a plurality of stoppers, each having a circumferential surface, wherein the circumferential surfaces have different diameters, which gradually increase from the oil zone toward the pump chamber.

3. The pump according to claim 2, wherein the oil chamber is one of a plurality of oil chambers, each corresponding to one of the circumferential surfaces, wherein the oil chambers form a bent path extending from the side closer to the pump chamber to the side closer to the oil zone.

4. The pump according to claim 3, wherein the bent path has a radially extending oil entering passage, wherein the oil entering passage connects an adjacent pair of the oil chambers.

5. The pump according to claim 4, wherein the oil entering passage is narrower than the oil chamber in the axial direction of the rotary shaft.

6. The pump according to claim 1, wherein a bent path is formed, wherein the bent path extends from the side closer to the pump chamber to the side closer to the oil zone and is connected to the oil chamber, wherein the stopper is arranged to narrow an outlet of the path.

7. The pump according to claim 1, further comprising a drainage channel connected to an area at which the oil flowing from an inner wall of the oil chamber is collected, wherein the drainage channel connects the oil chamber to the oil zone to conduct oil to the oil zone.

8. The pump according to claim 7, wherein the drainage channel is connected to the lowest area of the oil chamber.

9. The pump according to claim 8, wherein the drainage channel is relatively horizontal or is inclined downward toward the oil zone.

10. The pump according to claim 1, wherein the oil zone accommodates a bearing, which rotatably supports the rotary shaft.

11. The pump according to claim 1, further comprising:

an annular shaft seal, which is located around the projecting section to rotate integrally with the rotary shaft, wherein the shaft seal is located closer to the pump chamber than the stopper is and has a first seal forming surface that extends in a radial direction of the shaft seal;

a second seal forming surface formed on the oil housing member, wherein the second seal forming surface faces the first seal forming surface and is substantially parallel with the first seal forming surface; and a non-contact type seal located between the first and second seal forming surfaces.

12. The pump according to claim 1, further comprising:

a seal surface located on the oil housing;

an annular shaft seal, which is located around the projecting section to rotate integrally with the rotary shaft, wherein the shaft seal is located closer to the pump chamber than the stopper is, wherein the shaft seal includes a pumping means located on a surface of the shaft seal that faces the seal surface, wherein the pumping means guides oil between a surface of the shaft seal and the seal surface from the side closer to the pump chamber toward the side closer to the oil zone.

13. A vacuum pump that draws gas by operating a gas conveying body in a pump chamber through rotation of a rotary shaft, the vacuum pump comprising:

an oil housing member, wherein the oil housing member defines an oil zone adjacent to the pump chamber, and the rotary shaft has a projecting section that projects from the pump chamber to the oil zone through the oil housing member;

a plurality of stoppers, each having a circumferential surface, wherein the circumferential surfaces have different diameters, wherein the stoppers are located on the rotary shaft to integrally rotate with the rotary shaft and prevent oil from entering the pump chamber; and a plurality of annular oil chambers for collecting oil, wherein each oil chamber is located about the axis of the rotary shaft to surround the circumferential surface of one of the stoppers, and wherein the oil chambers form a bent path extending from the side closer to the pump chamber to the side closer to the oil zone.

14. The pump according to claim 13, further comprising a drainage channel connected to an area at which the oil flowing from an inner wall of the bent path is collected, wherein the drainage channel connects the bent path to the oil zone to conduct oil to the oil zone.

15. The pump according to claim 14, wherein the drainage channel is connected to the lowest area of the bent path.

16. The pump according to claim 15, wherein the drainage channel is relatively horizontal or is inclined downward toward the oil zone.

17. The pump according to claim 13, wherein the oil zone accommodates a bearing, which rotatably supports the rotary shaft.

* * * * *